US005466298A

United States Patent [19]

Pollock

[11] Patent Number: 5,466,298

[45] Date of Patent: Nov. 14, 1995

[54] WEB CLEANING METHOD

[75] Inventor: Rodney E. Pollock, Camas, Wash.

[73] Assignee: James River Paper Company, Inc., Richmond, Va.

[21] Appl. No.: 130,460

[22] Filed: Oct. 1, 1993

[51] Int. Cl.[6] ..... B08B 5/02

[52] U.S. Cl. ..... 134/15; 134/37

[58] Field of Search ..... 34/156, 111; 15/306, 15/308, 346; 134/1, 9, 37, 15; 226/97; 69/1

[56] References Cited

U.S. PATENT DOCUMENTS

| | | | |
|---|---|---|---|
| 2,515,223 | 7/1950 | Hollick | 69/1 |
| 3,078,496 | 2/1963 | Doran et al. | 15/346 |
| 3,420,710 | 1/1969 | Wollman | 134/1 |
| 3,436,265 | 4/1969 | Gardner | 134/37 |
| 3,587,177 | 6/1971 | Overly et al. | 34/156 |
| 3,629,952 | 12/1971 | Overly et al. | 34/156 |
| 3,650,043 | 3/1972 | Overly et al. | 34/156 |
| 3,775,806 | 12/1973 | Olbrant et al. | 15/306 |
| 4,247,993 | 2/1981 | Lindstrom | 34/156 |
| 4,594,748 | 6/1986 | Warfvinge | 15/308 |
| 4,643,775 | 2/1987 | Reba et al. | 134/15 |
| 4,932,140 | 6/1990 | Lepisto | 34/156 |
| 5,304,254 | 4/1994 | Chino et al. | 134/37 |

*Primary Examiner*—Jan H. Silbaugh
*Assistant Examiner*—Robin S. Gray
*Attorney, Agent, or Firm*—Thomas R. Lampe

[57] ABSTRACT

An apparatus and method for cleaning a moving web of sheet material. The apparatus includes a Coanda nozzle having an elongated, curved foil and a slit for directing gas at a high rate of speed along the foil. The gas from the foil impacts a layer of air entrained by the web of sheet material flowing in an opposed direction. Impact occurs within a gap formed between the foil and the web which becomes increasingly restricted in the direction of movement of the web. The entrained layer of air is caused to reverse direction within the gap and is mixed with the gas from the nozzle under turbulent conditions to clean the web and remove particulate material such as dust therefrom.

1 Claim, 2 Drawing Sheets

WEB CLEANING METHOD

TECHNICAL FIELD

This invention relates to a system for cleaning webs of sheet material. More particularly, the apparatus and method of the present invention have application to removing dust and other particulate matter in an entrained boundary layer carried along by fast moving paper or other webs.

BACKGROUND ART

Many arrangements exist in the prior art for cleaning moving webs such as paper webs. Dust and other entrained particles are often carried along by such webs and can present health and safety problems as well as quality control problems.

It will be appreciated that dust and other particles must be quickly and positively removed from fast moving webs such as those found in paper making and paper conversion facilities. The arrangement of the present invention accomplishes this objective in a highly efficient, relatively low cost manner. One of the components of the present system is a Coanda nozzle of specialized construction which is positioned adjacent to the web in a particular manner which provides a highly turbulent interface between air flow from the nozzle and the entrained layer of air moving with and bordered by the moving web.

While it is known generally to deploy one or more Coanda nozzles along the path of a moving web to treat the web in some manner or direct movement of the web, the arrangement of the present invention incorporates structure and method steps which cooperate in a unique manner to effectively and positively clean even very fast moving webs.

The following United States patents are believed representative of the current state of the art in this field: U.S. Pat. No. 4,932,140, issued Jun. 12, 1990, U.S. Pat. No. 4,594,748, issued Jun. 17, 1986, U.S. Pat. No. 3,650,043, issued Mar. 21, 1972, U.S. Pat. No. 3,629,952, issued Dec. 28, 1971, U.S. Pat. No. 3,587,177, issued Jun. 28, 1971, U.S. Pat. No. 2,515,223, issued Jul. 18, 1950, U.S. Pat. No. 3,078,496, issued Feb. 26, 1963, U.S. Pat. No. 3,775,806, issued Dec. 4, 1973, and U.S. Pat. No. 4,247,993, issued Feb. 3, 1981.

U.S. Pat. No. 3,775,806 discloses apparatus for removing and collecting dust from a traveling sheet or web of material including a blow box having means for impinging jets of clean air against the sheet both in the direction of travel of the sheet and in the opposed direction. A suction box cooperates with the blow box to form suction gaps withdrawing the air after its engagement with the material to remove the dust from the material.

U.S. Pat. No. 3,078,496 discloses web cleaning apparatus for cleaning a running web of material, such as paper, fabric, or plastic. A pressurized flow of air flows through a restricted passageway about a bulbous element and impinges against a moving web. The direction of web travel and the direction of the air flow are virtually identical. The air flow and entrained matter are then drawn into a suction box.

U.S. Pat. No. 4,932,140 discloses a nozzle box having a carrying face placed facing a web. Two nozzle slots blow toward each other with flow converging above the carrying face. The arrangement of this patent is intended for contact-free supporting and treatment, such as drying, heating or cooling, of paper webs and other continuous webs.

U.S. Pat. No. 4,594,748, discloses an apparatus for cleaning particles from a web. An air flow is directed against the web through a pressure slit whereupon the air flow is deflected and guided along the web to two suction slits. The air flow is directed against the web by means of a nozzle in the shape of two expanding blades, each ending in an edge. The suction slits are surrounded by two blades and another two blades prevent the inlet of surrounding air.

U.S. Pat. No. 4,247,993 discloses nozzle apparatus for airborne paper web dryers of the non-impingement or underpressure type including a blow box member defined by top web supporting and bottom wall portions and back and front wall portions. The front and top supporting wall portions are interconnected by a curved guide surface and an upwardly directed nozzle is provide on the front wall portion spaced below the entry edge plane of the guide surface.

U.S. Pat. No. 3,650,043 discloses an air foil web stabilizer constructed with its opposite ends disposed generally at a slight angle to provide a lateral component to the air discharge in the general direction of web movement to thereby remove wrinkles from the web.

U.S. Pat. No. 3,587,177 discloses an arrangement for the treatment of surfaces such as a web of material to be cleaned, dried or stabilized without physical contact with the web. An air foil nozzle is provided from which cleaning, drying or stabilizing gas is discharged tangentially against the web.

U.S. Pat. No. 3,629,952 discloses an air foil nozzle adjacent a moving web to be dried and constructed with a substantially flat planular guide surface trailing the nozzle, facing the web and substantially parallel thereto.

DISCLOSURE OF INVENTION

The present invention is for use in combination with a web of sheet material moving in a direction of web movement along a path of web movement. The web of sheet material has spaced edges and a substantially planar surface bordering a layer of air entrained by the web of sheet material and moving in the direction of web movement.

The apparatus is for cleaning the substantially planar surface of the web of sheet material and includes a Coanda nozzle comprising an elongated, curved foil and slit defining means defining an elongated, narrow slit with the elongated, curved foil.

The elongated, narrow slit is for receiving a compressed gas and directing the gas at a high rate of speed along the elongated, curved foil from an upstream location on the elongated, curved foil and past an intermediate location on the elongated, curved foil to a downstream location at an end of the elongated, curved foil. The terms "upstream" and "downstream" are used in the conventional sense, indicating locations on the foil in order of passage of flowing gas therealong. The term "intermediate" designates a location between the upstream location and the downstream location, the conventional accepted meaning of the word "intermediate" in the present context.

The Coanda nozzle is positioned closely adjacent to the substantially planar surface of a moving web of sheet material with the downstream location of the elongated, curved foil being further from the substantially planar surface than is the elongated, curved foil intermediate location. The elongated, curved foil forms a gap with the moving web substantially planar surface which becomes increasingly restricted in the direction of web movement and within which a layer of air entrained by the moving web of sheet material is impacted by gas flowing at a high rate of speed along the curved foil in a direction opposed to the direction of web movement, mixed with the gas under turbulent conditions and substantially simultaneously caused to reverse direction away from the curved foil.

The apparatus additionally comprises an air discharge chute and means for applying a vacuum to the air discharge chute to direct the mixture of gas and entrained air layer to a location away from the Coanda nozzle. The discharge chute includes a curved, discharge plate adjacent to the elongated, curved foil and curving away from the Coanda nozzle.

The curved discharge plate has an elongated entry end located at the Coanda nozzle and extending along the length of the Coanda nozzle. The curved discharge plate elongated entry end is offset from the elongated, curved foil downstream location along the length of the Coanda nozzle and located a greater distance from the substantially planar surface of the moving web than the distance between the elongated, curved foil where the foil adjoins the curved discharge plate to promote turbulence of the gas and entrained air layer in the gap.

The elongated, narrow slit has a substantially uniform width within the range of from about 0.002 inches to about 0.02 inches. The compressed gas has a pressure within the range of from about 2 psig to about 10 psig prior to flowing through the slit. The compressed gas exits the slit at a speed within the range of from about 29,800 fpm to about 66,600 fpm.

Other features, advantages, and objects of the present invention will become apparent with reference to the following description and accompanying drawings.

BEST MODE FOR CARRYING OUT THE INVENTION

Figure 1:
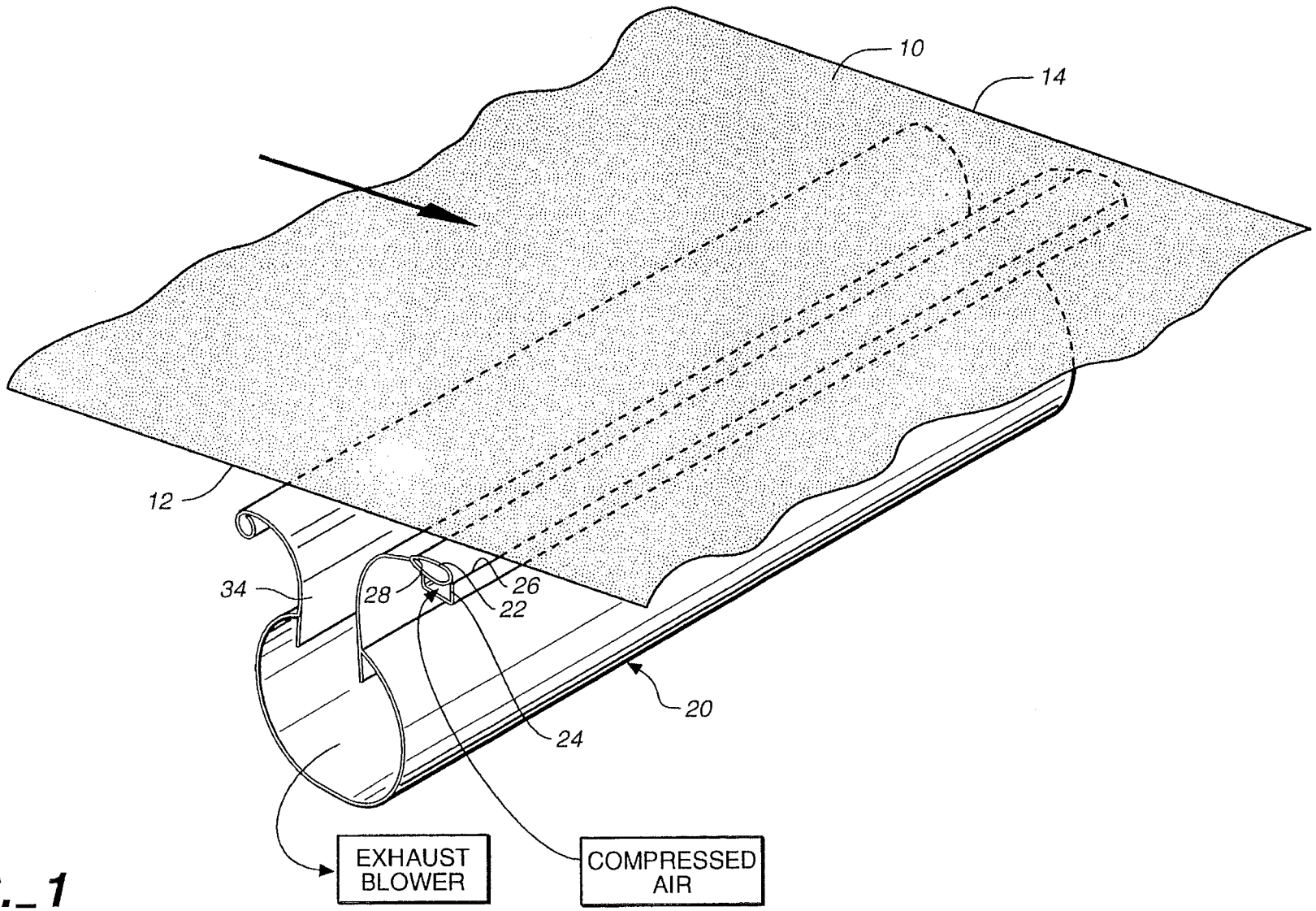
FIG. 1 is a perspective view of apparatus constructed in accordance with the teachings of the present invention in operative association with a moving web.

Referring now to the drawings, a web of sheet material, more particularly a paper web 10, is illustrated as moving in a direction of web movement along a web path indicated by the arrow. Web 10 has spaced edges 12, 14 and a substantially planar surface 16 bordering a layer of air 18 (the lower limit of which is denoted by dash lines in FIG. 2) entrained by the web and moving in the same direction as the web.

It will be appreciated that layer 18 often includes dust and other particulate matter generated during manufacturing or conversion processes. It is the function of the apparatus constructed in accordance with the teachings of the present invention to quickly and efficiently remove such substances from association with the web. Proper cleaning of the web is particularly imperative in those situations wherein the dust or particulate materials represent health or safety problems, as is often the case. For example, dust and other particles, in the absence of proper web treatment, can cause respiratory problems or have the potential for fire or even explosion.

Figure 2:
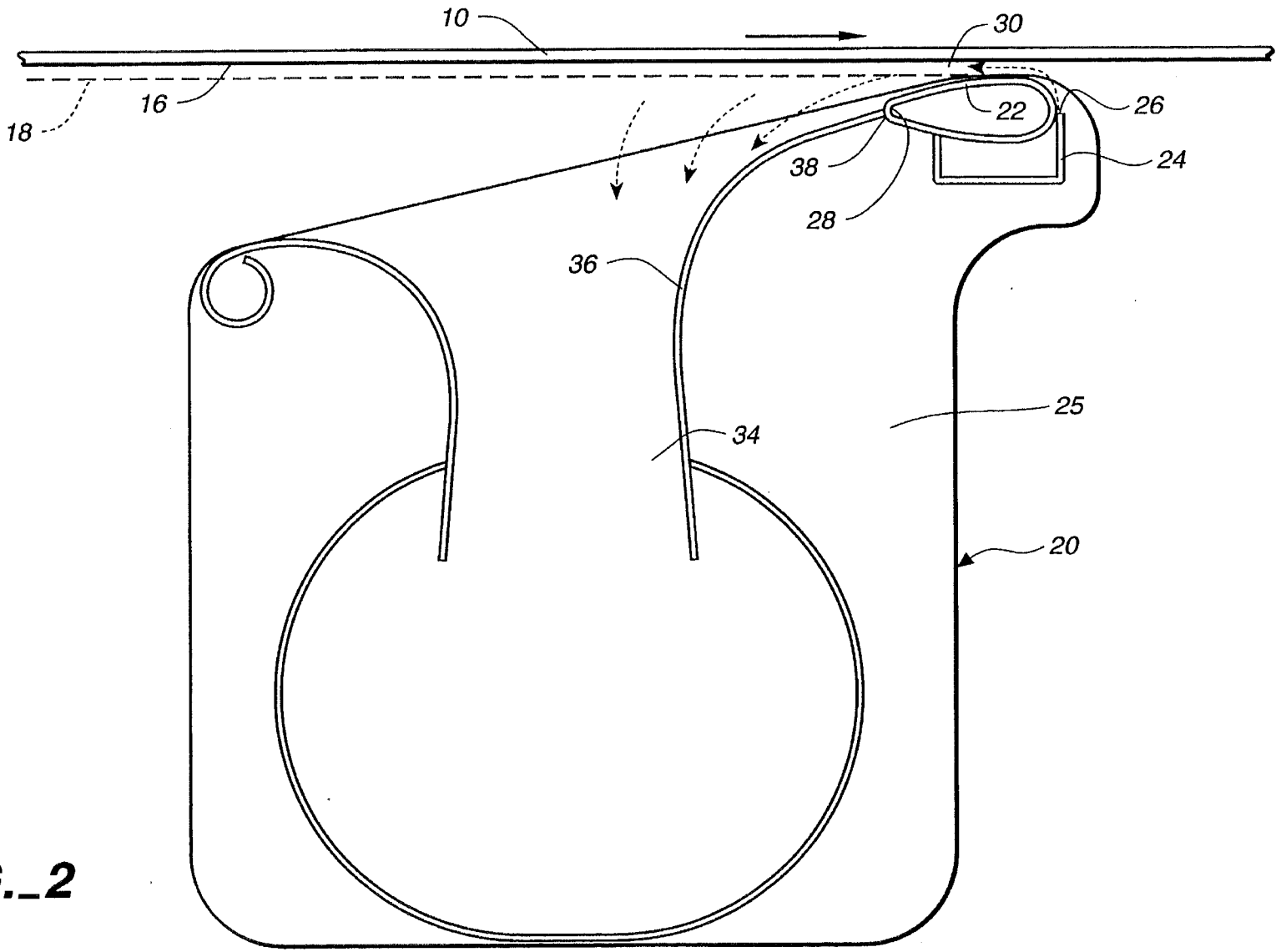
FIG. 2 is a cross-sectional side view of the apparatus disposed under a moving web.

The apparatus 20 of the present invention is located adjacent to web 10 and includes a Coanda nozzle having an elongated, curved foil 22 and a housing 24 defining an elongated, narrow slit 26 with the elongated, curved foil. The interior of housing 24 is connected to a source of pressurized air or other gas. End plates, such as end plate 25 illustrated in FIG. 2, block ends of the housing 24 to ensure maintenance of gas pressure in the housing. In the interest of simplicity, end plates are not illustrated in FIG. 1 and only one such end plate 25 is shown in FIG. 2.

The pressurized air or other gas exits slit 26 at a high rate of speed, attaching itself to the elongated, curved foil 22 as a result of the Coanda effect. Such gas movement will also serve to entrain ambient air at the location of the Coanda nozzle whereby the gas and ambient air entrained thereby will move from the upstream location on the foil located at the slit and past an intermediate location on the foil closely adjacent to the moving web to a downstream location at the end 28 of the elongated, curved foil.

This will result in impact by the gas and ambient air entrained thereby on the layer of air 18 entrained by web 10. In other words, the flow or direction of movement of air boundary layer 18 will be in opposition to the direction of movement of the gas and entrained ambient air along the foil surface.

It will be noted that the curved foil downstream or end location 28 is further from the substantially planar surface 16 of the web 10 than is the elongated, curved foil intermediate location. Thus, the elongated, curved foil forms a gap 30 with the moving web 10 substantially planar surface which becomes increasingly restricted (narrows) in the direction of movement of the web 10. That is, as is clearly shown in FIG. 2, the distance between the foil and the web decreases in the direction of web movement. The layer of air entrained by the moving web of sheet material is impacted by the gas and ambient air flowing at a high rate of speed along the curved foil within the gap 30. This results in mixing of the layer of air, gas, and air entrained thereby under turbulent conditions and substantially simultaneously causes the layer of air 18 to reverse direction away from the curved foil. Since the turbulence adjoins the planar surface 16, a scouring or cleaning action takes place ensuring removal of loose particulate matter from association with the web planar surface.

The apparatus of the present invention also includes an air discharge chute 34 which is utilized to direct the gas and particulate mixture away from the Coanda nozzle to a desired location. For example, the mixture may be directed to a filter (not shown) for filtering out the particulates. Preferably, a vacuum is applied to the air discharge chute by an exhaust blower or other suitable vacuum means to ensure transport of the gas-particulate mixture to the desired remote location.

Discharge chute 34 includes a curved, discharge plate 36 adjacent to the elongated, curved foil 22 and curving away from the Coanda nozzle. The curved, discharge plate 36 has an elongated entry end 38 located at the Coanda nozzle and extending along the length of the Coanda nozzle. The curved, discharge plate elongated entry end 38 is offset from the elongated, curved foil downstream location along the length of the Coanda nozzle and located a greater distance from the substantially planar surface of the moving web than the distance between the elongated, curved foil downstream location 28 where the foil adjoins the curved discharge plate. It has been found that such an arrangement promotes turbulence of the gas, entrained ambient air, and entrained air layer in the gap. In turn, this contributes to the cleaning efficiency of the apparatus.

The Coanda nozzle and air discharge chute extend all the way across the web of sheet material from edge 12 to edge 14. That is, the primary axis of the Coanda nozzle is disposed at substantially right angles to the direction of web movement.

For efficient operation of the apparatus, the elongated, narrow slit 26 has a uniform width within the range of from about 0.002 inches to about 0.02 inches, and even more preferably a width of about 0.01 inch. It is also important that the compressed gas employed for operation of the Coanda nozzle is pressurized within a range of from about 2 psig to about 10 psig prior to flow thereof through the slit. Even more preferably, the compressed gas has a pressure of about 5 psig.

In operation, the gas exits the slit and flows along at least the upstream end of said elongated, curved foil surface at a speed within a range of from about 29,800 fpm (feet per minute) to about 66,600 fpm (feet per minute). Operation of the nozzle within such range significantly contributes to the efficiency of the apparatus in cleaning the web and should be compared with prior art devices wherein gas flow speeds and gas pressures are significantly less as well as less effective. Of course, one skilled in the art can readily determine without undue experimentation the gas speed required to effect mixing and reversal of direction of the layer of air merely by observing or monitoring gas and air flow.

I claim:

1. A method of cleaning a moving web of sheet material having associated thereon dust or other particulate materials, moving in a direction of web movement along a web path, said moving web of sheet material further having spaced edges and a substantially planar surface bordering a boundary layer of air entrained by said moving web of sheet material and moving in said direction of web movement, said method comprising the steps of:

flowing gas under a pressure within the range of from about 2 psig to about 10 psig through an elongated, narrow slit having a substantially uniform width within the range of from about 0.002 inches to about 0.02 inches extending completely across said moving web of sheet material from edge to edge thereof and at right angles to said direction of web movement at a speed within the range of from about 29,800 fpm to about 66,600 fpm;

changing the direction of flow of said gas after said gas has passed through said elongated, narrow slit by attaching said gas to an elongated, curved foil surface due to the Coanda effect and then flowing said gas along said elongated, curved toil surface at a high rate of speed and in a direction opposed to said direction of web movement, said curved foil surface being located adjacent to said substantially planar surface of said moving web of sheet material, a gap being formed between said elongated, curved foil surface and said substantially planar surface of said moving web, which gap diminishes in size in said direction of web movement, said curved foil surface extending completely across said moving web of sheet material from edge to edge thereof and at right angles to said direction of web movement;

entraining ambient air with said gas as said gas flows along said elongated, curved foil surface at a high rate of speed whereby the ambient air entrained with said gas moves in a direction opposed to said direction of web movement along with said gas;

impacting said boundary layer of air and dust or other particulate materials entrained by said moving web of sheet material in said gap with said gas and said ambient air entrained thereby while said gas and ambient air are moving in said direction opposed to said direction of web movement;

mixing said boundary layer of air and dust or other particulate materials, said gas and said ambient air entrained by said gas in said gap under turbulent conditions to form a mixture;

substantially simultaneously with the step of mixing to form said mixture, causing said boundary layer of air and dust or other particulate materials to reverse direction and move in said direction opposed to said direction of web movement; and applying a vacuum to said mixture to change the direction of said mixture and redirect said mixture to a location spaced from both said web of sheet material and said elongated, curved foil surface, thereby removing said dust or other particulate materials from association with said web, said mixture being redirected along a mixture flow path at least partially defined by a curved discharge surface curving away from said elongated, curved foil surface and said moving web toward a discharge chute, said mixture flow path extending from edge to edge of said moving web of sheet material and extending away from and generally perpendicular to the substantially planar surface of said moving web of sheet material, said curved discharge surface having an entry end offset from said elongated, curved foil surface and located a greater distance from said substantially planar surface of said moving web of sheet material than the distance between said elongated, curved foil surface and said substantially planar surface of said moving web of sheet material, and said mixture engaging said offset entry end upon moving away from said elongated, curved foil surface to promote turbulence of said mixture.

* * * * *